United States Patent [19]

Siemsen

[11] 4,352,639

[45] Oct. 5, 1982

[54] PNEUMATIC PUMP

[75] Inventor: Henry S. Siemsen, Los Angeles, Calif.

[73] Assignee: Bryce Bowmar, Burbank, Calif.

[21] Appl. No.: 204,864

[22] Filed: Nov. 7, 1980

[51] Int. Cl.[3] ..... F04B 1/06

[52] U.S. Cl. ..... 417/134; 417/140

[58] Field of Search ..... 417/118, 124, 126, 127, 417/134, 137, 138, 140

[56] References Cited

U.S. PATENT DOCUMENTS

| | | | |
|---|---|---|---|
| 761,065 | 5/1904 | Elliott | 417/140 |
| 873,906 | 12/1907 | Sillett | 417/140 |
| 1,616,017 | 2/1927 | Williams | 417/118 |

*Primary Examiner*—Richard E. Gluck
*Attorney, Agent, or Firm*—Flam & Flam

[57] ABSTRACT

A submersible pump casing is supported for limited vertical movement. Buoyancy of the casing changes according to the amount of water in the chamber. When pressurized air continuously supplied to the chamber has discharged most of the water, the casing rises, opening a vent and allowing an inrush of water through a large inlet at the bottom of the casing. A float closes the vent and the cycle repeats. The vent is a simple flapper, and the vent itself is large whereby the filling is quickly accomplished. The flapper is cracked to allow quick opening by a simple push rod and bar mechanism.

6 Claims, 5 Drawing Figures

PNEUMATIC PUMP

FIELD OF INVENTION

This invention relates to a submersible water pump that is operated by compressed air.

BACKGROUND OF THE INVENTION

The present invention is intended to satisfy the demand for a small rugged water pump that can be teamed up with a wind machine and an air compressor driven by the machine. The primary object of this invention is to provide a water pump of this character that utilizes simple and reliable mechanisms for performing valve functions in a positive displacement pump organization.

SUMMARY OF THE INVENTION

In order to achieve this objective, I provide a submersible pump casing that is supported for limited vertical movement. Compressed air is continuously supplied to the top of the pump chamber, causing water to be discharged through outlet means at the bottom of the chamber. Internal pressure maintains a large inlet valve closed. As water is discharged, a point is reached when the buoyancy of the casing is neutral. By controlling the weight and size of the casing, the neutral buoyancy condition occurs just before the casing is emptied. Further displacement of water causes positive buoyancy and rapid rise of the casing. As the casing approaches its upward limit, abutment means operate a large vent whereupon internal pressure is released. The inlet valve opens in response to release of internal pressure and water rushes in nearly to fill the pump chamber before the increased weight of the case overcomes inertia. A float then closes off the large vent opening and the compressed air pressurizes the chamber as the inlet valve settles to close. The cycle then repeats.

A series of downwardly projecting outlet tubes conveniently form a cage for the ball closure of the inlet at the lower end and for the float at the upper end. Both the inlet valve and the vent valve are very large in order to provide quick and nearly complete filling. The vent valve is designed as a simple flapper type, covering both a main vent orifice and a secondary small orifice. The small orifice is opened by small force so that the closing force of the compressed air is overcome by a cracking technique.

BRIEF DESCRIPTION OF THE DRAWINGS

A detailed description of the invention will be made with reference to the accompanying drawings wherein like numerals designate corresponding parts in the several figures. These drawings, unless described as diagrammatic or unless otherwise indicated, are to scale.

FIG. 4 is a fragmentary sectional view similar to FIG. 2, but showing the case in its upward position, vent open and water rushing in.

DETAILED DESCRIPTION OF PREFERRED EMBODIMENT

The following detailed description is of the best presently contemplated modes of carrying out the invention. This description is not to be taken in a limiting sense, but is made merely for purposes of illustrating the general principles of the invention, since the scope of the invention is best defined by the appended claims. Structural and operational characteristics attributed to forms of the invention first described, shall also be attributed to forms later described, unless such characteristics are obviously inapplicable or unless specific exception is made.

Figure 1:
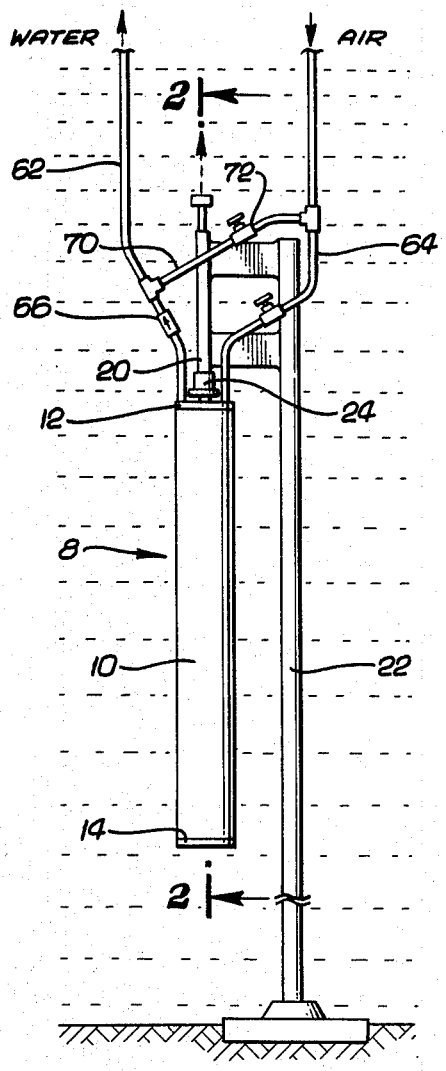
FIG. 1 is a side elevational view of the submersible pump mounted on a standard.

The pneumatic pump 8 shown in FIG. 1 comprises a pump casing 10 made of a length of cylindrical plastic or metal tubing approximately four to six inches in diameter, and top and bottom end pieces or caps 12 and 14 (FIG. 2) fitted and secured to the ends of the casing 10. The pump 8 is supported in a vertical orientation by the aid of a vent pipe 16. The vent pipe is threadedly attached to the center of the end cap 12 in registry with a through central vent opening 18 in the cap 12. The pipe 16 projects into a tubular guide 20, in turn supported by a standard 22 (FIG. 1).

Figure 4:
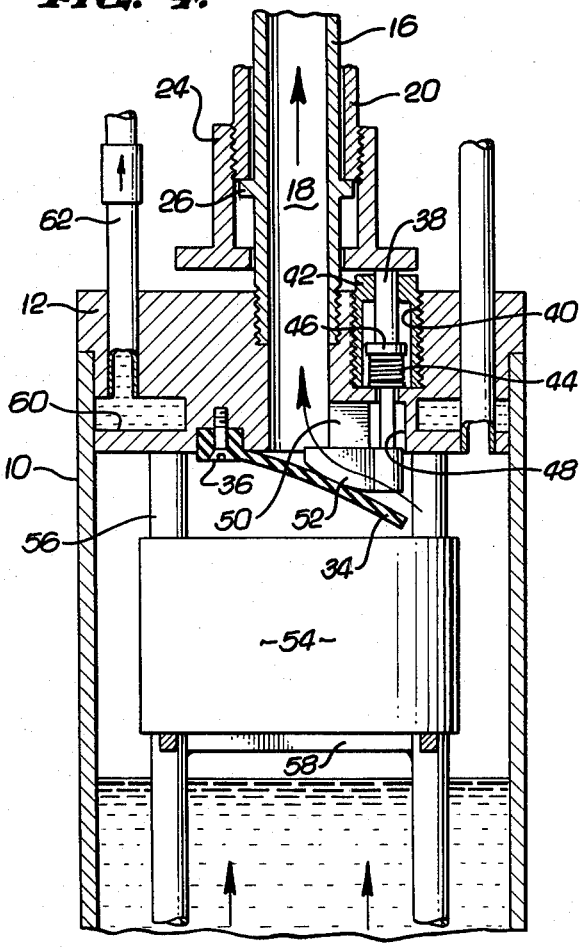
Figure 2:
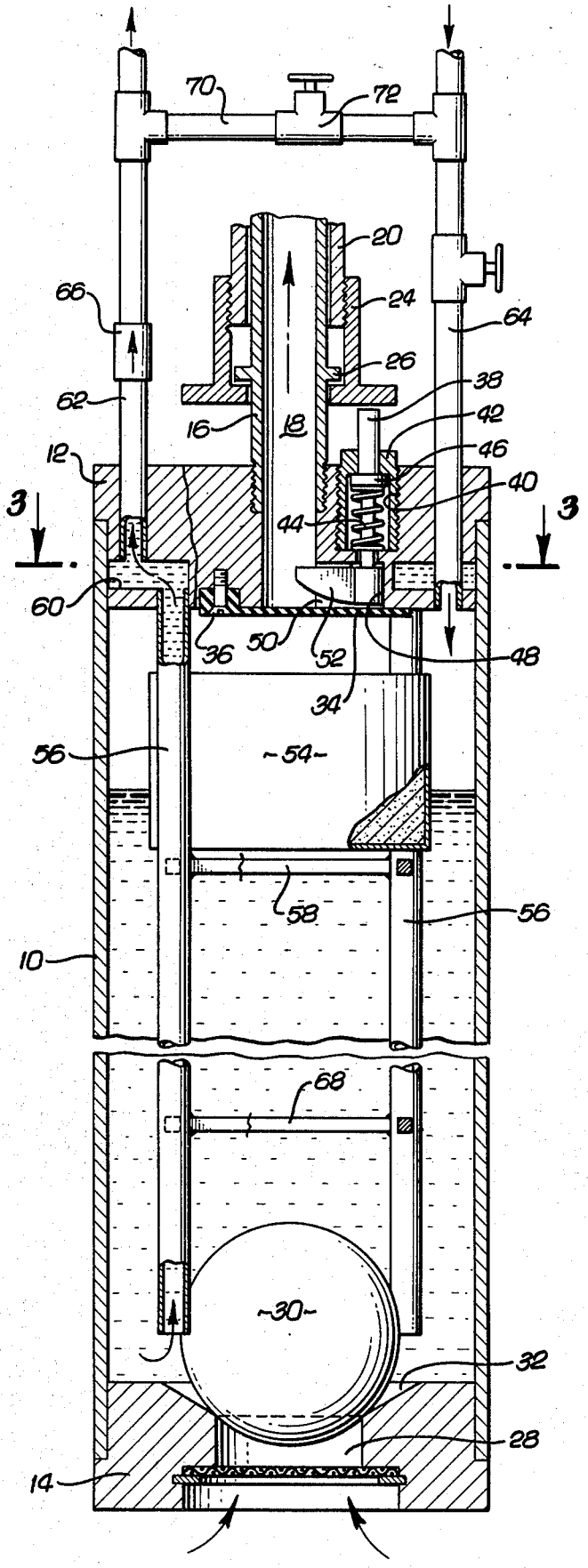
FIG. 2 is an enlarged vertical sectional view of the pump taken along a plane corresponding to line 2—2 of FIG. 1.

A collar 24 (FIGS. 2 and 4) threadedly attached to the lower end of the guide 20 cooperates with a stop ring 26 on the vent pipe 16 to limit downward movement of the pipe 16 and, hence, the pump 8. Engagement of the stop ring 26 with the lower end of the guide 20 limits upward movement. The range of movement is about an inch or two. Ambient water enters the casing 10 through a large diameter opening 28 (FIG. 4) in the lower end cap 14, and is trapped in by a ball 30 that has a specific gravity slightly greater than water. The ball 30 cooperates with a seat 32 on the inside of the cap 14. Ambient water will enter the pump chamber if the vent 18 is open. The vent 18 is opened and closed by a resilient flapper 34 attached to the inside surface of the upper cap 12 as by the aid of screws 36. The resilience of the flapper 34 normally causes the flapper 34 to assume a position flat across the vent opening 18 as shown in FIG. 2. The flapper 34 is pushed downwardly and away from the vent opening by the aid of a push rod 38 that operates when the casing 10 arrives at its upper position of FIG. 4.

Figure 3:
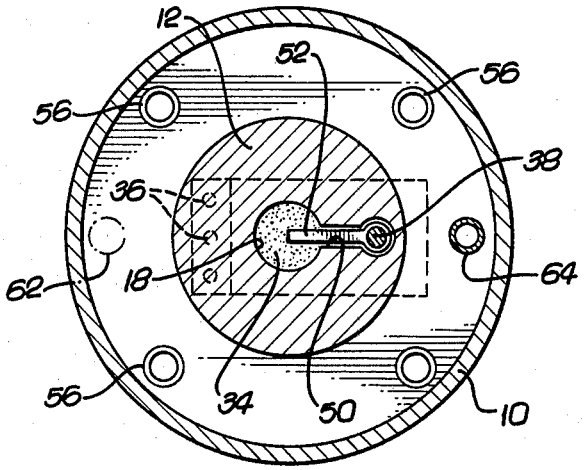
FIG. 3 is a transverse sectional view taken along a plane corresponding to line 3—3 of FIG. 2.

The push rod 38 extends through the bottom of an upwardly opening threaded recess 40 and is guided for vertical movement therein by a hollow cap 42. A compression spring 44 projects the push rod 38 to an upper position (FIG. 2) determined by engagement of a stop collar 46 with the inside of the cap 42. When the push rod 38 is projected upwardly by the spring 44, its lower end is retracted within a recess 48 located on the inside of the cap 12. The recess 48 is joined to the vent opening 18 by the aid of a slot 50 (see also FIG. 3). The recess 48 is closed by the very distal portion of the flapper 34. The lower end of the push rod 38 carries a bar 52 that extends through the slot 50 and into the region of the main vent 18. The undersurface of the bar 52 is curved so that as the push rod 38 first operates, the edge of the flapper 34 is engaged by the end of the push rod 38. Portions of the flapper 34 progressively engage the more central regions of the flapper 34 as relative movement of the push rod 38 progresses. Thus, the flapper 34 is cracked for initial venting through the auxiliary opening 48 whereby pressure on opposite sides of the flapper 34 is equalized. Thereupon, full opening of the flapper 34 is readily achieved.

As water nearly fills the casing 10, a relatively large float 54 moves upwardly to engage the flapper 34 and the stopped push rod 38, the weight of the water initiating downward movement of the casing 10 and retraction of the push rod 38.

The float 54 is guided for limited vertical movement near the top of the casing 10 by the aid of four outlet tubes 56 (see also FIG. 3) that project downwardly from the upper cap 12 nearly to the level of the lower cap 14 (FIG. 2). Cross bars 58 laterally brace the outlet tubes 56 and limit downward movement of the float 54 away from the flapper 34.

The tubes 56 register at their upper ends with an annular collection channel 60 and an outlet conduit 62, at least portions of which are flexible to allow for the reciprocating movement of the casing to which the conduit 62 is attached.

The weight of the casing, increased by the volume of water admitted into the casing, assist the action of the float 54 to cause the casing to drop and the flapper 34 to close. The ball 30 at the bottom of the casing 10 settles into closed position. Compressed air, such as provided from a windmill operated compressor, is continuously admitted into the casing 10 via a conduit 64 that projects through the upper cap 12 and through the annular collection channel 60. As pressure builds, the flapper 34 firmly seats and water is forced into the outlet tubes 56, collection channel 60 and outlet conduit 62. A check valve 66, if desired, prevents reverse flow during that portion of the cycle when water enters the casing 10.

When much of the water in the chamber has been pumped out, the buoyancy of the casing 10 with associated equipment becomes neutral. This point is desirably achieved when the water level is slightly above the lower ends of the discharge tubes 56. Further removal of water under the influence of air pressure causes buoyancy rather rapidly to lift the casing 10 upwardly so that the push rod 38 engages the collar 24. The flapper valve is cracked open thereby, and readily opened to the full extent. Full opening of the vent 18 allows a heavy inrush of water and a repeat of the cycle. The ball 30 is caged by the lower ends of the discharge tubes 56. Bars 68 (FIG. 2) limit upward movement of the ball 30.

The lift obtained by the pump depends upon the pressure of air supplied. Lift is increased by using compressed air to lighten the column in the discharge conduit. This is achieved by a bypass conduit 70 (FIG. 1) controlled by a valve 72 that connects the air line 64 to the outlet conduit 62.

DESCRIPTION OF ALTERNATIVE EMBODIMENT

Figure 5:
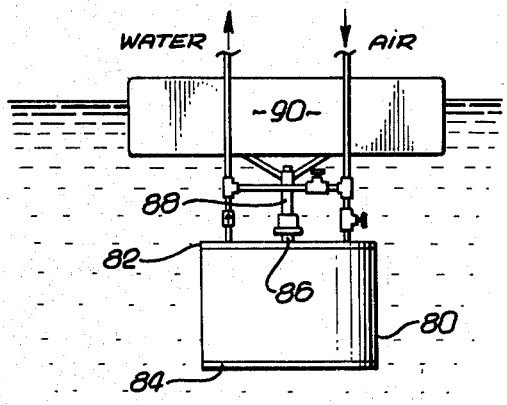
FIG. 5 is a diagrammatic view of a similar submersible pump mounted on a float for purposes of pumping surface water.

In the form of the invention shown in FIG. 5, a pump casing 80 is closed by end caps 82 and 84. A vent pipe 86 is accommodated in a guide 88 suspended from a float 90. For shallow pond operation, the diameter of the casing 80 may be increased, thus to minimize its vertical dimension, yet to achieve reasonable displacement per cycle.

Intending to claim all novel, useful and unobvious features shown or described, I make the following claims:

1. In a pneumatic pump:
(a) a hollow pump casing;
(b) a relatively fixed guide means supporting the pump casing for limited vertical movement in accordance with its positive and negative buoyancy;
(c) means forming a vent opening adjacent the upper end of the casing;
(d) a valve normally closing the vent opening;
(e) conduit means for continuously admitting air under pressure into the pump casing;
(f) outlet conduit means opening near the lower end of the pump casing for conducting water forced from the casing;
(g) means forming a large water inlet for conducting water into the lower end of the casing;
(h) means for substantially preventing reverse flow through said water inlet means;
(i) means operated upon arrival of said casing to its upper limit for opening said vent valve to allow inrush of water through said inlet meams; and
(j) means for closing said vent valve as said casing substantially fills with water whereby air under pressure works upon the water to force it through said outlet conduit means.

2. A pneumatic pump as set forth in claim 1 in which said vent valve comprises a resilient flapper that normally overlies said vent opening, said vent valve opening means comprising a push rod movably supported by the casing and engaged by the guide means, said vent closing means comprising a float supported in the casing positioned to engage said flapper and which in turn engages said push rod.

3. The pneumatic pump as set forth in claim 2 in which said outlet conduit means includes a plurality of discharge tubes extending downwardly into said casing, said discharge tubes forming a cage for guiding said float.

4. The pneumatic pump as set forth in claim 3 in which said reverse flow preventing means includes a free closure caged by the lower ends of said discharge tubes.

5. The pneumatic pump as set forth in claim 2 in which said push rod has a lower end accommodated in a relatively small recess adjacent said vent opening, and which recess is normally covered by the distal end of said flapper; there being means connecting said recess to said vent opening; said push rod first cracking said flapper before fully opening said flapper.

6. The pneumatic pump as set forth in claim 5 together with a bar carried by said push rod engageable with said flapper and having a configuration for progressively moving said flapper away from said recess and vent opening.

* * * * *